US009111492B2

(12) United States Patent
Kim

(10) Patent No.: US 9,111,492 B2
(45) Date of Patent: Aug. 18, 2015

(54) PIXEL, ORGANIC LIGHT EMITTING DISPLAY INCLUDING THE PIXEL AND DRIVING METHOD THEREOF

(71) Applicant: Samsung Display Co., Ltd., Yongin (KR)

(72) Inventor: Hyung-Soo Kim, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 121 days.

(21) Appl. No.: 14/058,618

(22) Filed: Oct. 21, 2013

(65) Prior Publication Data

US 2014/0333677 A1 Nov. 13, 2014

(30) Foreign Application Priority Data

May 13, 2013 (KR) ..... 10-2013-0053669

(51) Int. Cl.
*G09G 3/30* (2006.01)
*G09G 3/10* (2006.01)
*G09G 3/32* (2006.01)

(52) U.S. Cl.
CPC ..... *G09G 3/3291* (2013.01)

(58) Field of Classification Search
CPC ..... G09G 3/3233; G09G 2300/0819; G09G 2300/0852; G09G 2300/0861; G09G 2310/0251; G09G 2310/0262; G09G 3/3275
USPC ..... 345/76–84, 204–215, 690–699; 315/169.1–169.4
See application file for complete search history.

(56) References Cited

U.S. PATENT DOCUMENTS

| | | | | |
|---|---|---|---|---|
| 7,760,171 | B2 | 7/2010 | Kwon | |
| 2010/0013868 | A1* | 1/2010 | Chung | 345/690 |
| 2011/0175881 | A1* | 7/2011 | Kim | 345/211 |
| 2014/0210696 | A1* | 7/2014 | Kim | 345/82 |

FOREIGN PATENT DOCUMENTS

| | | |
|---|---|---|
| KR | 10-2005-0085309 | 8/2005 |
| KR | 10-0732853 | 6/2007 |
| KR | 10-2008-0002398 | 1/2008 |

* cited by examiner

*Primary Examiner* — Kent Chang
*Assistant Examiner* — Nelson Rosario
(74) *Attorney, Agent, or Firm* — H.C. Park & Associates, PLC

(57) ABSTRACT

An organic light emitting display includes a scan driver, a data driver, a current sink unit, and pixels. The scan driver is configured to provide a first scan signal to first scan lines and a second scan signal to second scan lines. The data driver is configured to provide a data signal to first data lines and a voltage data signal to second data lines. The current sink unit is configured to provide a current data signal to third data lines. The pixels are configured to store a voltage corresponding to the voltage data signal and the current data signal. A light emission time of the pixels is controlled by the data signal.

20 Claims, 3 Drawing Sheets

PIXEL, ORGANIC LIGHT EMITTING DISPLAY INCLUDING THE PIXEL AND DRIVING METHOD THEREOF

CROSS-REFERENCE TO RELATED APPLICATION

This application claims priority from and the benefit of Korean Patent Application No. 10-2013-0053669, filed on May 13, 2013, which is incorporated by reference for all purposes as if set forth herein.

BACKGROUND

1. Field

Exemplary embodiments relate to display technology, and, more particularly, to a pixel, an organic light emitting display including the pixel, and a driving method of the organic light emitting display.

2. Discussion

Various types of flat panel displays have been developed to reduce the weight and volume of conventional cathode ray tubes. For example, typical flat panel displays include: liquid crystal displays, field emission displays, electrophoretic displays, electrowetting displays, plasma displays, organic light emitting displays, and the like. Among these flat panel displays, organic light emitting displays are configured to display images using organic light emitting diodes that emit light through recombination of electrons and holes. Organic light emitting displays typically have a relatively fast response time and are usually driven to consume relatively lower amounts of power.

The above information disclosed in this Background section is only for enhancement of understanding of the background of the invention, and, therefore, it may contain information that does not form the prior art that is already known in this country to a person of ordinary skill in the art.

SUMMARY

Exemplary embodiments provide a pixel configured to display an image at desired luminance, an organic light emitting display including the pixel, and a driving method of the organic light emitting display.

Additional aspects will be set forth in the detailed description which follows and, in part, will be apparent from the disclosure, or may be learned by practice of the invention.

According to exemplary embodiments, an organic light emitting display includes: a scan driver configured to provide a first scan signal to first scan lines and a second scan signal to second scan lines; a data driver configured to provide a data signal to first data lines and a voltage data signal to second data lines; a current sink unit configured to provide a current data signal to third data lines; and pixels configured to store a voltage corresponding to the voltage data signal and the current data signal. A light emission time of the pixels is controlled by the data signal.

According to exemplary embodiments, a pixel includes: an organic light emitting diode; a first transistor configured to provide current from a first power source to the organic light emitting diode via a third node based on a voltage applied to a first node; a second transistor coupled between the third node and a third data line, the second transistor being configured to be turned on when a first scan signal is provided to a third scan line; a third transistor coupled between the first and third nodes, the third transistor being configured to be turned on when the first scan signal is supplied to the third scan line; a first capacitor coupled between the first node and the first power source; a fourth transistor coupled between the first node and a second node, the fourth transistor being configured to be turned on when a second scan signal is provided to a second scan line; and a second capacitor coupled between the second node and the first power source.

According to exemplary embodiments, a method includes: storing, based on a current data signal, a first voltage in a first voltage storage device while sinking current from a pixel; storing, in response to a voltage data signal being provided to the pixel, a second voltage in a second voltage storage device; applying a third voltage to a gate electrode of a driving transistor, the third voltage corresponding to the sum of the first and second voltages; and controlling, in association with a frame, light emission of the pixel and a coupling between the driving transistor and an organic light emitting diode of the pixel at least twice.

The foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
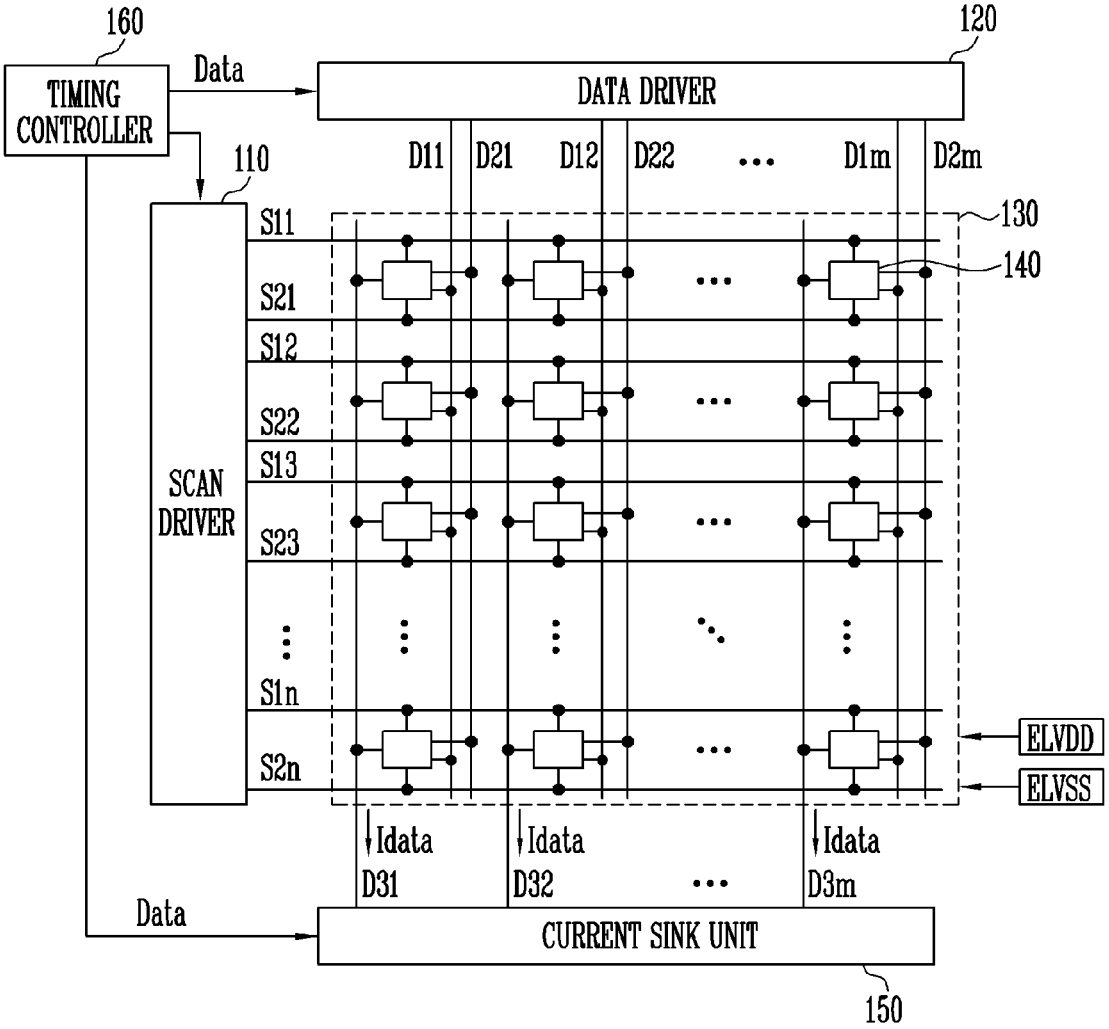
FIG. 1 is a block diagram of an organic light emitting display, according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature (s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram of an organic light emitting display, according to exemplary embodiments. As shown, the organic light emitting display may include scan driver 110, data driver 120, pixel unit 130, current sink unit 150, and timing controller 160. Although specific reference will be made to this particular implementation, it is also contemplated that the organic light emitting display may embody many forms and include multiple and/or alternative components. For example, it is contemplated that the components of the organic light emitting display may be combined, located in separate structures, and/or separate locations.

Referring to FIG. 1, the pixel unit 130 includes pixels 140 positioned at intersection portions of first scan lines S11 to S1n and first data lines D11 to D1m. The scan driver 110 is configured to drive the first scan lines S11 to S1n and second scan lines S21 to S2n. The data driver 120 is configured to drive the first data lines D11 to D1m and second data lines D21 to D2m. The current sink unit 150 is configured to drive third data lines D31 to D3m. The timing controller 160 is configured to control the scan driver 110, the data driver 120, and the current sink unit 150. Each of the scan driver 110, data driver 120, pixel unit 130, pixel 140, current sink unit 150, and timing controller 160 are described below in more detail.

Figure 3:
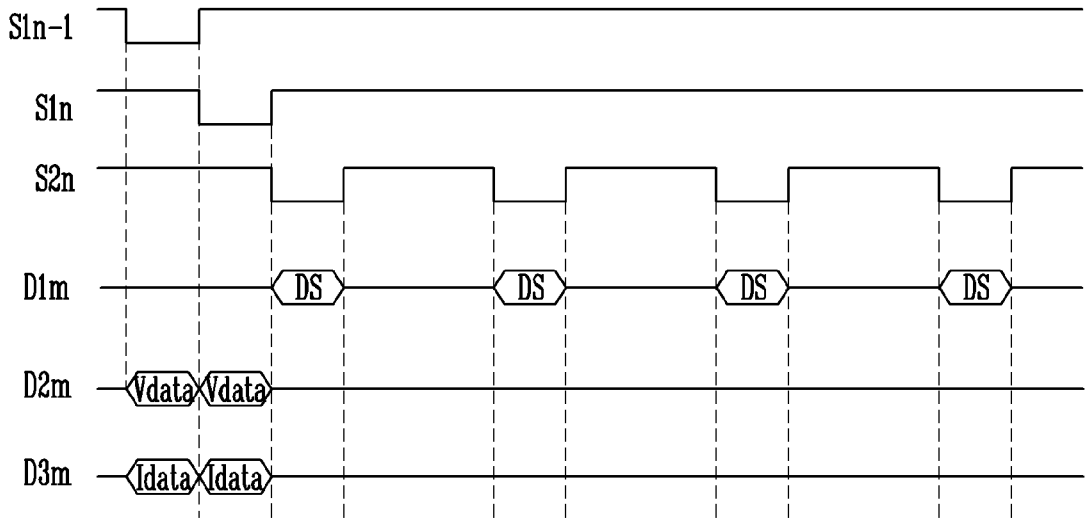
FIG. 3 is a waveform diagram of driving waveforms, according to exemplary embodiments.

According to exemplary embodiments, the scan driver 110, as shown in FIG. 3, is configured to supply a first scan signal to the first scan lines S11 to S1n, and a second scan signal to the second scan lines S21 to S2n. For example, the scan driver 110 may progressively supply the first scan signal to the first scan lines S11 to S1n during a frame. If the first scan signal is progressively supplied, pixels 140 may be selected for each scan line. To this end, the scan driver 110 is further configured to supply two or more second scan signals to each of the second scan lines S21 to S2n during the a frame. For example, during the frame, the scan driver 110 may supply the first scan signal to an i-th (where "i" is a natural number) first scan line S1i and supply two or more second scan signals to an i-th second scan line S2i at a determined interval.

The current sink unit 150 is configured to supply a current data signal Idata to the third data lines D31 to D3m in synchronization with the first scan signal. It is noted that the current data signal Idata is a determined current that is sunk (or otherwise drawn) from the pixel 140 selected by the first scan signal. The current data signal Idata may be set with one or more current levels. For example, the current sink unit 150 may control current corresponding to a determined current level to be sunk via each of the third data lines D31 to D3m, corresponding to data Data supply from, for instance, the timing controller 160. That is, the current data signal Idata may have one or more current levels, and may be selected to have a determined level for each channel, corresponding to the data Data. To this end, the current level of the current data signal Idata may be experimentally determined, so that a desired voltage may be charged in the pixel 140 during the supply period of the first scan signal.

In exemplary embodiments, the data driver 120 is configured to supply a voltage data signal Vdata to the second data lines D21 to D2m in synchronization with the first scan signal, as well as configured to supply a data signal DS to the first data lines D11 to D1m in synchronization with the second scan signal. For example, the data driver 120 may supply a voltage data signal Vdata having a determined voltage level among a plurality of voltage levels to each of the second data lines D21 to D2m, so that a desired gray scale may be implemented in correspondence with the data Data supplied from, for instance, the timing controller 160. In this manner, the data driver 120 may be configured to supply, in synchronization with the second scan signal, a data signal DS for controlling emission or non-emission of the pixel 140 to the first data lines D11 to D1m.

The pixel unit 130 may be configured to receive a first power source ELVDD and a second power source ELVSS, which may be supplied from, for instance, a power supply external to the organic light emitting display. The first and second power sources ELVDD and ELVSS supplied to the pixel unit 130 may be supplied to each pixel 140 of the pixel unit 130.

Pixels 140 positioned on an i-th scan line extending in a first direction, e.g., a horizontal direction, may charge a voltage corresponding to the current data signal Idata when the first scan signal is supplied to an (i−1)-th first scan line S1i−1, and may charge a voltage corresponding to the voltage data signal Vdata when the first scan signal is supplied to the i-th scan line S1i. The pixels 140 positioned on the i-th line may or may not emit light corresponding to the data signal DS when the second scan signal is supplied to an i-th second scan line S2i. In this manner, pixels 140 may be configured to display an image of a determined gray scale. To this end, each pixel 140 may be configured to implement a gray scale when selected in an emission or non-emission state twice or more during a frame.

Although each pixel 140 is shown coupled to one first scan line and one second scan line, any other suitable configuration may be utilized. For example, each pixel 140 may be additionally coupled to a first scan line positioned on a previous line extending in the first direction. In this manner, an S1j-th scan line S1j (not shown) may be additionally formed adjacent to an S1j+1-th scan line S1j+1, where "j" is a natural number.

In exemplary embodiments, the scan driver 110, data driver 120, current sink unit 150, timing controller 160, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features/functions/processes described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the scan driver 110, data driver 120, current sink unit 150, timing controller 160, and/or one or more components thereof may include or otherwise be associated with one or more memories (not shown) including code (e.g., instructions) configured to cause the scan driver 110, data driver 120, current sink unit 150, timing controller 160, and/or one or more components thereof to perform one or more of the features/functions/processes described herein.

The memories may be any medium that participates in providing code/instructions to the one or more software, hardware, and/or firmware for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Figure 2:
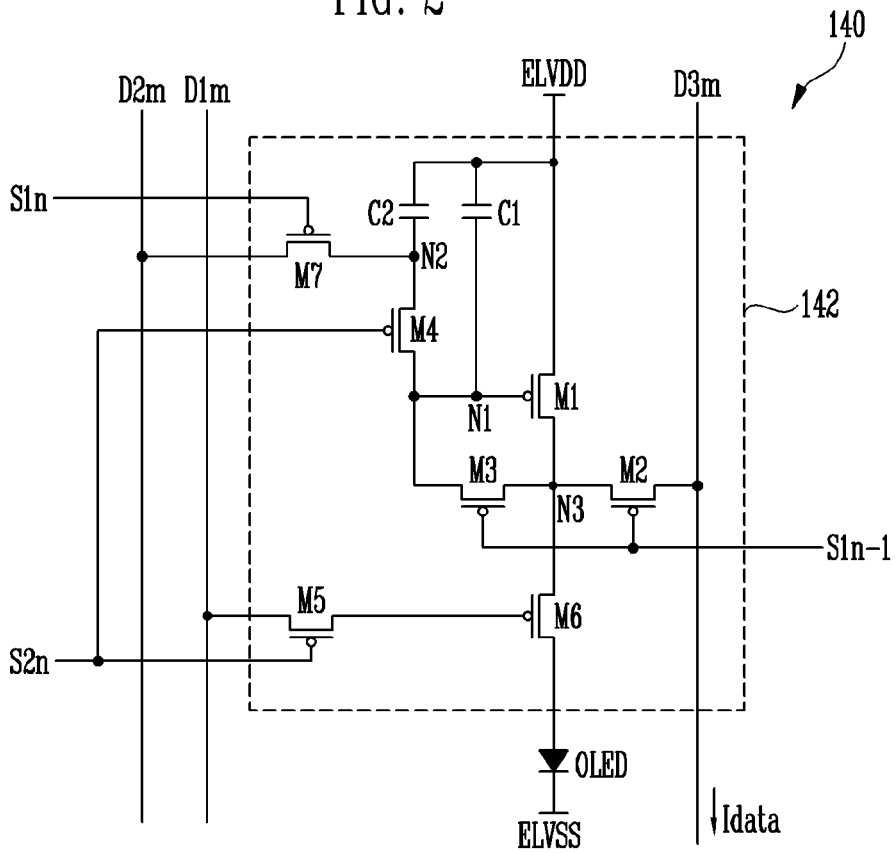
FIG. 2 is a circuit diagram of a pixel of the organic light emitting display, according to exemplary embodiments.

FIG. 2 is a circuit diagram of a pixel, according to exemplary embodiments. For convenience, a pixel at least associated with one or more n-th scan lines and one or more m-th data lines is shown in FIG. 2. Other pixels of the pixel unit 130 may include a substantially similar configuration, and, as such, to avoid obscuring exemplary embodiments described herein, the pixel illustrated in FIG. 2 will be described as a representative pixel.

Referring to FIG. 2, the pixel 140 may include an organic light emitting diode OLED and a pixel circuit 142 configured to control the amount of current supplied to the organic light emitting diode OLED. Although specific reference will be made to this particular implementation, it is also contemplated that pixel 140 may embody many forms and include multiple and/or alternative components/configurations.

According to exemplary embodiments, the organic light emitting diode OLED is configured to generate (or otherwise emit) light of a determined luminance based on the amount of current supplied thereto from the pixel circuit 142.

The pixel circuit 142 is configured to charge a determined voltage corresponding to a current data signal Idata and a voltage data signal Vdata, as well as configured to supply a current corresponding to the charged voltage to the organic light emitting diode OLED. The pixel circuit 142 is configured to control a time when the current is supplied to the organic light emitting diode OLED based on the data signal DS. To this end, the pixel circuit 142 may include, for instance, first to seventh switching units (e.g., transistors) M1 to M7, a first capacitor C1, and a second capacitor C2.

A first electrode of the first transistor M1 is coupled to the first power source ELVDD, and a second electrode of the first transistor M1 is coupled to a third node N3. A gate electrode of the first transistor M1 is coupled to a first node N1. The first transistor M1 is configured to control the amount of current supplied to the organic light emitting diode OLED based on a voltage applied to the first node N1.

A first electrode of the second transistor M2 is coupled to the third node N3, and a second electrode of the second transistor M2 is coupled to a third data line D3m. A gate electrode of the second transistor M2 is coupled to an (n−1)-th first scan line S1n−1. The second transistor M2 is turned on when the first scan signal is supplied to the (n−1)-th first scan line S1n−1 so as to allow the third data line D3m and the third node N3 to be electrically coupled to each other.

As seen in FIG. 2, a first electrode of the third transistor M3 is coupled to the first node N1, and a second electrode of the third transistor M3 is coupled to the third node N3. A gate electrode of the third transistor M3 is coupled to the (n−1)-th first scan line S1n−1. The third transistor M3 may be "turned on" when the first scan signal is supplied to the (n−1)-th first scan line S1n−1, which may enable the first and third nodes N1 and N3 to be electrically coupled to each other. In this manner, the first transistor M1 may be considered as being diode-coupled.

According to exemplary embodiments, a first electrode of the fourth transistor M4 is coupled to a second node N2, and a second electrode of the fourth transistor M4 is coupled to the first node N1. A gate electrode of the fourth transistor M4 is coupled to a second scan line S2n. The fourth transistor M4 may be "turned on" when the second scan signal is supplied to the second scan line S2n, which may enable the second and first nodes N2 and N1 to be electrically coupled to each other.

A first electrode of the fifth transistor M5 is coupled to a first data line D1m, and a second electrode of the fifth transistor M5 is coupled to a gate electrode of the sixth transistor M6. A gate electrode of the fifth transistor M5 is coupled to the second scan line S2n. The fifth transistor M5 may be "turned on" when the second scan signal is supplied to the second scan line S2n, which may enable the first data line D1m and the gate electrode of the sixth transistor M6 to be electrically coupled to each other.

As shown in FIG. 2, a first electrode of the sixth transistor M6 is coupled to the third node N3, and a second electrode of the sixth transistor M6 is coupled to a first electrode (e.g., an anode electrode) of the organic light emitting diode OLED. The gate electrode of the sixth transistor M6 is coupled to the second electrode of the fifth transistor M5. The sixth transistor M6 may be "turned on" or "turned off" based on the data signal DS supplied on the first data line D1m when the fifth transistor M5 is "turned on." It is noted that a second electrode (e.g., a cathode electrode) of the organic light emitting diode OLED may be coupled to the second power source ELVSS.

In exemplary embodiments, a first electrode of the seventh transistor M7 is coupled to a second data line D2m, and a second electrode of the seventh transistor M7 is coupled to the second node N2. A gate electrode of the seventh transistor M7 is coupled to an n-th first scan line S1n. The seventh transistor M7 may be "turned on" when the first scan signal is supplied to the n-th first scan line S1n, which may enable the second data line D2m and the second node N2 to be electrically coupled to each other.

The first capacitor C1 is coupled between the first node N1 and the first power source ELVDD. The first capacitor C1 is configured to charge (or otherwise store) a voltage corresponding to the current data signal Idata. The second capacitor C2 is coupled between the second node N2 and the first power source ELVDD. In this manner, the second capacitor C2 is configured to charge (or otherwise store) a voltage corresponding to the voltage data signal Vdata.

FIG. 3 is a waveform diagram of driving waveforms, according to exemplary embodiments.

Referring to FIGS. 1-3, the first scan signal is supplied to the (n−1)-th first scan line S1n−1 so that the second and third transistors M2 and M3 are turned on. When the third transistor M3 is turned on, the first and third nodes N1 and N3 are electrically coupled to each other, and, as such, the first transistor M1 is diode-coupled. When the second transistor M2 is turned on, the third node N3 and the third data line D3m are electrically coupled to each other. In this manner, the current sink unit 150 is configured to supply a current data signal Idata to the third data line D3m. In other words, the current sink unit 150 is configured to sink a determined current corresponding to the current data signal Idata. The determined current sunk from the current sink unit 150 is enabled to flow based on the first power source ELVDD, the first transistor M1, and the second transistor M2. In this manner, a voltage corresponding to the determined current is applied to the first node N1. The voltage is stored in the first capacitor C1.

According to exemplary embodiments, the voltage stored in the first capacitor C1 is determined by a determined current flowing via the first transistor M1. As such, a voltage is charged in the first capacitor C1 regardless of the threshold voltage and mobility of the first transistor M1. Additionally, the current level of the current data signal Idata is determined so that a desired voltage can be charged at the first node N1 during a period in which the first scan signal is supplied. In this manner, the voltage can be stably charged in the first capacitor C1.

After the voltage is charged in the first capacitor C1, the first scan signal is supplied to the first scan line S1n, which turns on the seventh transistor M7. When the seventh transistor M7 is turned on, a voltage data signal Vdata from the second data line D2m is supplied to the second node N2. In this manner, the second capacitor C2 is charge with a voltage corresponding to the voltage data signal Vdata.

Thereafter, the second scan signal is supplied to the second scan line S2n to turn on the fourth and fifth transistors M4 and M5. When the fourth transistor M4 is turned on, the second and first nodes N2 and N1 are electrically coupled to each other. As such, a voltage corresponding to a desired gray scale is applied to the first node based on the sum of the voltages stored in the first and second capacitors C1 and C2. To this end, when the fifth transistor M5 is turned on, the first data line D1m ad the gate electrode of the sixth transistor M6 are electrically coupled to each other. When the first data line D1m and the gate electrode of the sixth transistor M6 are electrically coupled to each other, a data signal DS is supplied to the gate electrode of the sixth transistor M6. To this end, the sixth transistor M6 is configured to control the coupling between the first transistor M1 and the organic light emitting diode OLED while being turned on or turned off based on the data signal DS.

According to exemplary embodiments, when the sixth transistor M6 is turned on by the data signal DS, the current from the first transistor M1 is supplied to the organic light emitting diode OLED based on the voltage at the first node N1. In this manner, the organic light emitting diode OLED generates (or otherwise emits) light of a determined luminance. When, however, the sixth transistor M6 is turned off by the data signal DS, the organic light emitting diode OLED is set in a non-emission state regardless of the voltage at the first node N1.

In exemplary embodiments, the voltage at the first node N1 may be controlled via the current data signal Idata with one or more current levels and the voltage data signal Vdata with a plurality of voltage levels. That is, the voltage at the first node N1 may be controlled using the current data signal Idata and the voltage data signal Vdata, which may improve the display quality (e.g., gray scale expression) of the organic light emitting display. Further, the emission time is additionally controlled using the data signal DS. As such, a more detailed gray scale expression may be achieved.

Figure 4:
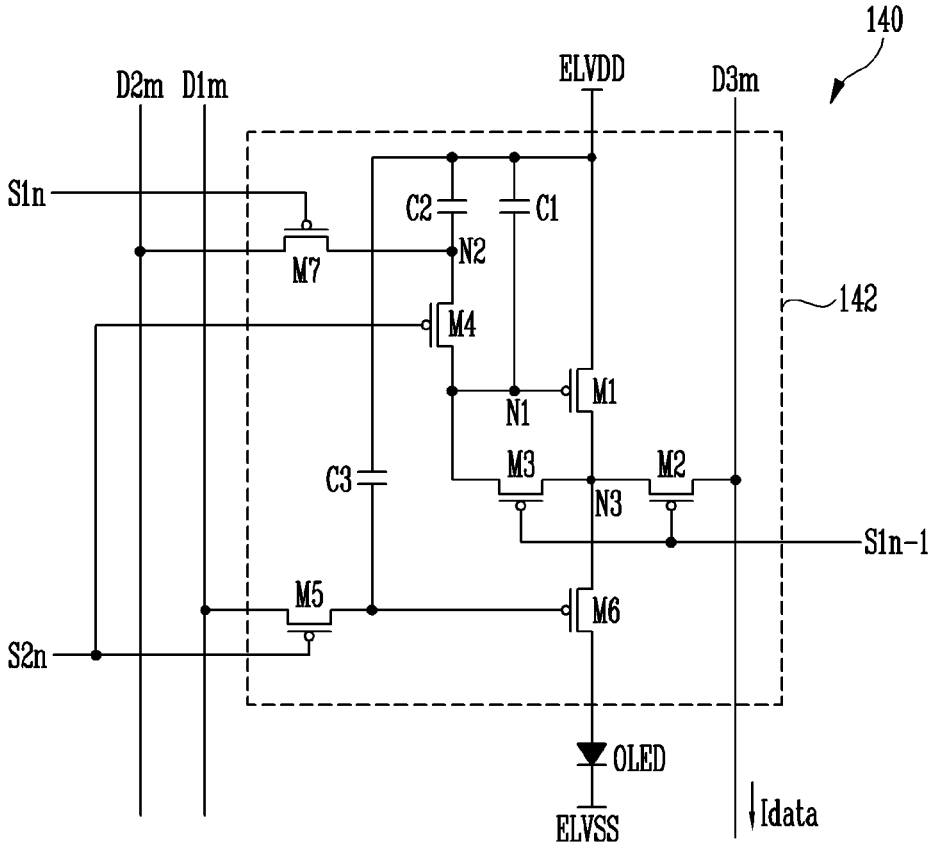
FIG. 4 is a circuit diagram of a pixel of the organic light emitting display, according to exemplary embodiments.

FIG. 4 is a circuit diagram of a pixel, according to exemplary embodiments. It is noted that pixel 140 of FIG. 4 is substantially similar to pixel 140 of FIG. 2, and, as such, differences are provided below to avoid obscuring exemplary embodiments described herein.

Referring to FIG. 4, the pixel 140 further includes a third capacitor C3 coupled between the gate electrode of the sixth transistor M6 and the first power source ELVDD. The third capacitor C3 is configured to store a determined voltage corresponding to the data signal DS when the fifth transistor M5 is turned on.

When the third capacitor C3 is omitted, the data signal DS is stored in a parasitic capacitor (not shown). In this manner, the data signal DS may not be stably charged, and, as such, the reliability of the pixel 140 may be diminished. To increase the reliability of the pixel 140, the third capacitor C3 is provided to store the voltage corresponding to the data signal DS when the fifth transistor M5 is turned on. Apart from the aforementioned difference, the configuration and operation of pixel 140 of FIG. 4 is substantially similar to that of pixel 140 of FIG. 2, and, as such, a duplicative description is omitted.

Although transistors M1 to M7 are shown as p-type metal-oxide-semiconductor (PMOS) transistors, it is contemplated that any other suitable transistor or switching element may be utilized. For instance, one or more of the transistors M1 to M7 may be n-type metal-oxide-semiconductor (NMOS) transistors.

According to exemplary embodiments, the organic light emitting diode OLED is configured to generate light of a determined color based on the amount of current supplied from the driving transistor. It is contemplated, however, that any other suitable organic light emitting diode may be utilized. For example, the organic light emitting diode OLED may generate white light based on the amount of the current supplied from the driving transistor, e.g., the sixth transistor M6. In this manner, a color image may be implemented using a separate color filter, etc., instead of or in addition to, the color(s) emitted by the various organic light emitting diodes of the pixel unit 130.

According to exemplary embodiments, an organic light emitting display may include a plurality of pixels arranged in a matrix form, e.g., at various intersection portions of a plurality of data lines, a plurality of scan lines, and a plurality of power lines. In this manner, each pixel may generate light of a determined luminance based on voltage stored in association with a data signal and supplied, using a driving transistor, to an organic light emitting diode based on a current associated with the stored voltage.

In conventional organic light emitting displays, a threshold voltage and mobility of a driving transistor included in each pixel may become unequal due to process variations, and, as such, an image with a desired luminance may not displayed. To overcome (or otherwise reduce) this effect, current may be provided as a data signal. If the current is supplied as the data signal, it is possible to implement an image with a desired luminance, regardless of a variation in the threshold voltage and mobility of a driving transistor. However, when the current is supplied as the data signal, it may be difficult to express low level gray scales. In other words, when a fine current is supplied to implement low level gray scales, a desired voltage may not be charged in a pixel in a determined time frame (e.g., a horizontal period 1H). As such, an image of a desired gray scale may be presented.

According to exemplary embodiments, an organic light emitting display is configured to express a gray scale based on the current data signal sunk from a pixel, the voltage data signal supplied to the pixel, and the emission time of the pixel. That is, a gray scale may be implemented using the current data signal, the voltage data signal, and the emission time of the pixel, which may improve the gray scale expression ability of the organic light emitting display. Further, the current data signal may be set to a current value so that a desired voltage may be stably charged in the pixel. In this manner, it is possible to display an image with a desired luminance regardless of the threshold voltage and mobility of the driving transistor.

Although certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. An organic light emitting display, comprising:

a scan driver configured to provide a first scan signal to first scan lines and a second scan signal to second scan lines;

a data driver configured to provide a data signal to first data lines and a voltage data signal to second data lines;

a current sink unit configured to provide a current data signal to third data lines; and pixels configured to store a voltage corresponding to the voltage data signal and the current data signal, wherein a light emission time of the pixels is controlled by the data signal.

2. The organic light emitting display of claim 1, wherein the data driver is configured to provide the data signal in synchronization with the second scan signal.

3. The organic light emitting display of claim 2, wherein the data signal is configured to control emission or non-emission of the pixels.

4. The organic light emitting display of claim 1, wherein the data driver is configured to provide the voltage data signal in synchronization with the first scan signal.

5. The organic light emitting display of claim 1, wherein the current sink unit is configured to provide the current data signal in synchronization with the first scan signal.

6. The organic light emitting display of claim 5, wherein the current data signal comprises one or more current levels.

7. The organic light emitting display of claim 6, wherein the current sink unit is configured to sink current from the pixels based on a current level of the current data signal.

8. The organic light emitting display of claim 6, wherein the current level of the current data signal is set so that a voltage corresponding to the current data signal is charged in a pixel during a period when the first scan signal is provided to the pixel.

9. The organic light emitting display of claim 1, wherein the scan driver is configured to:

progressively provide the first scan signal to the first scan lines during a frame; and provide two or more second scan signals to each second line during the frame.

10. The organic light emitting display of claim 9, wherein the scan driver is configured to provide two or more second scan signals to an i-th second scan line at an interval, after provision of the first scan signal to an i-th first scan line, where "i" is a natural number greater than zero.

11. The organic light emitting display of claim 1, wherein a pixel disposed in association with an i-th scan line, where "i" is a natural number greater than zero, comprises:

an organic light emitting diode;

a first transistor configured to provide current from a first power source to the organic light emitting diode via a third node based on a voltage applied to a first node;

a second transistor coupled between the third node and a third data line, the second transistor being configured to be turned on when the first scan signal is provided to an (i−1)-th first scan line;

a third transistor coupled between the first and third nodes, the third transistor being configured to be turned on when the first scan signal is provided to the (i−1)-th first scan line;

a first capacitor coupled between the first node and the first power source;

a fourth transistor coupled between the first node and a second node, the fourth transistor being configured to be turned on when the second scan signal is provided to an i-th second scan line; and a second capacitor coupled between the second node and the first power source.

12. The organic light emitting display of claim 11, wherein the pixel further comprises:

a sixth transistor coupled between the third node and the organic light emitting diode;

a fifth transistor coupled between a first data line and a gate electrode of the sixth transistor, the fifth transistor being configured to be turned on when the second scan signal is provided to the i-th second scan line; and a seventh transistor coupled between a second data line and the second node, the seventh transistor being configured to be turned on when the first scan signal is provided to an i-th first scan line.

13. The organic light emitting display of claim 12, wherein the pixel further comprises a third capacitor coupled between the first power source and the gate electrode of the sixth transistor.

14. A pixel, comprising:

an organic light emitting diode;

a first transistor configured to provide current from a first power source to the organic light emitting diode via a third node based on a voltage applied to a first node;

a second transistor coupled between the third node and a third data line, the second transistor being configured to be turned on when a first scan signal is provided to a third scan line;

a third transistor coupled between the first and third nodes, the third transistor being configured to be turned on when the first scan signal is provided to the third scan line;

a first capacitor coupled between the first node and the first power source;

a fourth transistor coupled between the first node and a second node, the fourth transistor being configured to be turned on when a second scan signal is provided to a second scan line; and a second capacitor coupled between the second node and the first power source.

15. The pixel of claim 14, wherein the pixel is connected to a first scan line, the pixel further comprising:

a sixth transistor coupled between the third node and the organic light emitting diode;

a fifth transistor coupled between a first data line and a gate electrode of the sixth transistor, the fifth transistor being configured to be turned on when the second scan signal is provided to the second scan line; and a seventh transistor coupled between a second data line and the second node, the seventh transistor being configured to be turned on when the first scan signal is provided to the first scan line.

16. The pixel of claim 15, further comprising a third capacitor coupled between the first power source and the gate electrode of the sixth transistor.

17. A method, comprising:

storing, based on a current data signal, a first voltage in a first voltage storage device while sinking current from a pixel;

storing, in response to a voltage data signal being provided to the pixel, a second voltage in a second voltage storage device;

applying a third voltage a gate electrode of a driving transistor, the third voltage corresponding to the sum of the first and second voltages; and controlling, in association with a frame, light emission of the pixel and a coupling between the driving transistor and an organic light emitting diode of the pixel at least twice.

18. The method of claim 17, wherein the voltage data signal corresponds to one of a plurality of voltage levels, the one voltage level being utilized to present a determined gray scale via the pixel.

19. The method of claim 17, wherein controlling the light emission of the pixel comprises providing, to a gate electrode of a transistor coupled between the driving transistor and the organic light emitting diode, a voltage corresponding to a turn-on or a turn-off voltage of the transistor.

20. The method of claim 17, wherein the current data signal comprises one or more current levels.

* * * * *